United States Patent [19]

Ahlgren et al.

[11] 3,960,072

[45] June 1, 1976

[54] AUTOMATIC LABEL-PRINTING APPARATUS

[75] Inventors: Erick L. Ahlgren; Arthur H. McMorris; Jerry L. Miille; Joseph L. Schweppe, all of Houston, Tex.

[73] Assignee: Houston Engineering Research Corporation

[22] Filed: Feb. 24, 1975

[21] Appl. No.: 552,224

[52] U.S. Cl. ..... 101/35; 101/1; 197/1 R

[51] Int. Cl.[2] ..... B41F 17/00

[58] Field of Search ..... 101/35, 41–44, 101/1 R, 122; 197/1 R

[56] References Cited

UNITED STATES PATENTS

| | | | |
|---|---|---|---|
| 2,819,669 | 1/1958 | Glunz | 101/35 |
| 2,819,671 | 1/1958 | Porter, Jr. et al. | 101/35 X |
| 3,520,981 | 7/1970 | Chambers | 197/1 R X |
| 3,648,601 | 3/1972 | Weidman | 101/35 |
| 3,745,920 | 7/1973 | McKay | 101/35 X |
| 3,867,882 | 2/1975 | Ahlgren et al. | 101/35 |
| 3,886,860 | 6/1975 | Hayakawa | 101/35 X |
| 3,892,174 | 7/1975 | Marcher | 101/35 |

*Primary Examiner*—E. H. Eickholt
*Attorney, Agent, or Firm*—Pravel & Wilson

[57] ABSTRACT

A new and improved automatic label printing apparatus for printing a label onto various types and shapes of packages and containers including a probe unit adapted to have mounted therewith a printing head. The probe unit is mounted for movement in three mutually perpendicular directions for locating a printable area on a container and for thereafter indexing the probe and printing head over the printable area for applying a label thereto. The probe unit is releaseably mounted to break away from its normal directional movement in order to prevent probe damage. In an alternate embodiment of this invention, a label printing apparatus is provided for printing a label onto a curved surface. And, in a further alternate embodiment, label printing apparatus is provided for printing a label at a rate coordinated with conveyor speed.

17 Claims, 15 Drawing Figures

AUTOMATIC LABEL-PRINTING APPARATUS

BACKGROUND OF THE INVENTION

The field of this invention is automatic label printing devices or the like.

Modern assembly-line production has precipitated the need for automatic label printing devices. Such label printing devices should be able to print varied information, which may differ not only from company to company but also from product to product within the same company. Such a lable printing device should be able to print a label upon packages of varying sizes and varying shapes. One such automatic label printing apparatus is disclosed in U.S. Pat. No. 3,867,882 "Apparatus for Printing Labels Directly onto Packages, Containers and the Like", assigned to the assignee of the present invention.

SUMMARY OF THE INVENTION

This invention relates to a new and improved label printing apparatus for locating a printable area on a carton, roll, container or other package and for printing a label thereon. The new and improved label printing apparatus of a preferred embodiment of this invention includes a probe unit adapted to have mounted therewith a printing head; and, probe mount means are provided for mounting the probe unit for movement along a first axis toward and away from a container. A carriage assembly supports the probe unit and a second axis mount means is provided for mounting the carriage assembly for movement along a second axis orthogonal to the first axis. A third axis mount means mounts the carriage assembly for movement along a third axis orthogonal to the first and second axis such that the probe unit is mounted for movement in three directions orthogonally oriented with respect to each other. The probe mount means includes a break-away means for mounting the probe unit for release from movement along the first axis in response to the probe unit engaging an undesirable resistance. Digital control means are provided for connection with the apparatus for coordinating the movement of the probe unit in the first, second and third orthogonally oriented directions to first isolate a printable area on a package or container and then print a label in the printable area utilizing a scanning or indexing technique.

One of the features of the preferred embodiment of this invention is a means for neutralizing the weight of the carriage assembly. Other features include endless belt-type drive assemblies for mounting the carriage assemblies for movement along both the second axis and the third axis. A connector means is provided for connecting the carriage assembly to the endless belt-type drive assembly of the second axis mount means for oscillating the carriage assembly along the second axis utilizing the full rotational cycle of the endless belt drive.

In a second embodiment of this invention, apparatus is provided for positioning a printing head and for printing a label on the top surface of a container or the like and includes a probe unit adapted to receive and support a label printer for movement in a vertical direction. A carriage assembly is provided with a probe mount means for mounting the probe unit for such vertical movement and first and second power means are provided for moving the probe unit in a horizontal plane along mutually perpendicular axes. The probe unit, probe unit mount means, carriage assembly and first and second power means cooperate to provide a portable label printing unit; and, height adjustment means mount the portable label printing unit for vertical movement in order to adjust the height of the portable label printing unit. The height adjustment means includes a first sprocket and chain drive arrangement mounted onto a main frame assembly for adjusting the height of the portable scanning unit. The first sprocket and chain drive arrangement is attached to appropriate counter-weight apparatus to balance the load of the portable label printing unit. The probe unit in this embodiment of this invention includes a yoke which is pivotally mounted onto the protruding end of the probe unit housing. The yoke houses the printing head and has mounted therewith a rotatable wheel which continually engages the curved surface in order to maintain the printing head in a desired position.

In a third embodiment of this invention, label printing apparatus is provided for adjusting the position of a probe unit having a printing head mounted therewith along a single axis for applying a label to a package or the like passing along a conveyor. This embodiment of the apparatus is particularly adapted to apply a label to a package or container which is known to have a printable area at a particular location. The label printing apparatus of this third embodiment of this invention includes digital control means for controlling the rate of printing and digital signal means adapted for connection with the conveyor and with the digital control means for providing a signal indicative of the speed of the conveyor whereby the digital control means adjusts the printing rate of the printing head accordingly.

DESCRIPTION OF THE PREFERRED EMBODIMENT

FIGS. 1–10 illustrate a printing head positioning apparatus A-1 for locating and applying a label to a printable area on a box, package, container, bale, roll, carton or any other object needing a label, herein designated as P-1, of various sizes and shapes. FIGS. 11–14 illustrate a second embodiment of this invention of a printing head positioning apparatus A-2 for printing a label onto the top, surface S of a package or roll P-2. And, FIG. 15 illustrates a third embodiment of this invention of a printing head positioning apparatus A-3 for applying a label to a package P-3 having a known printable area, the rate of printing of the label being coordinated with the speed of the conveyor C on which the package P-3 travels.

Figure 15:
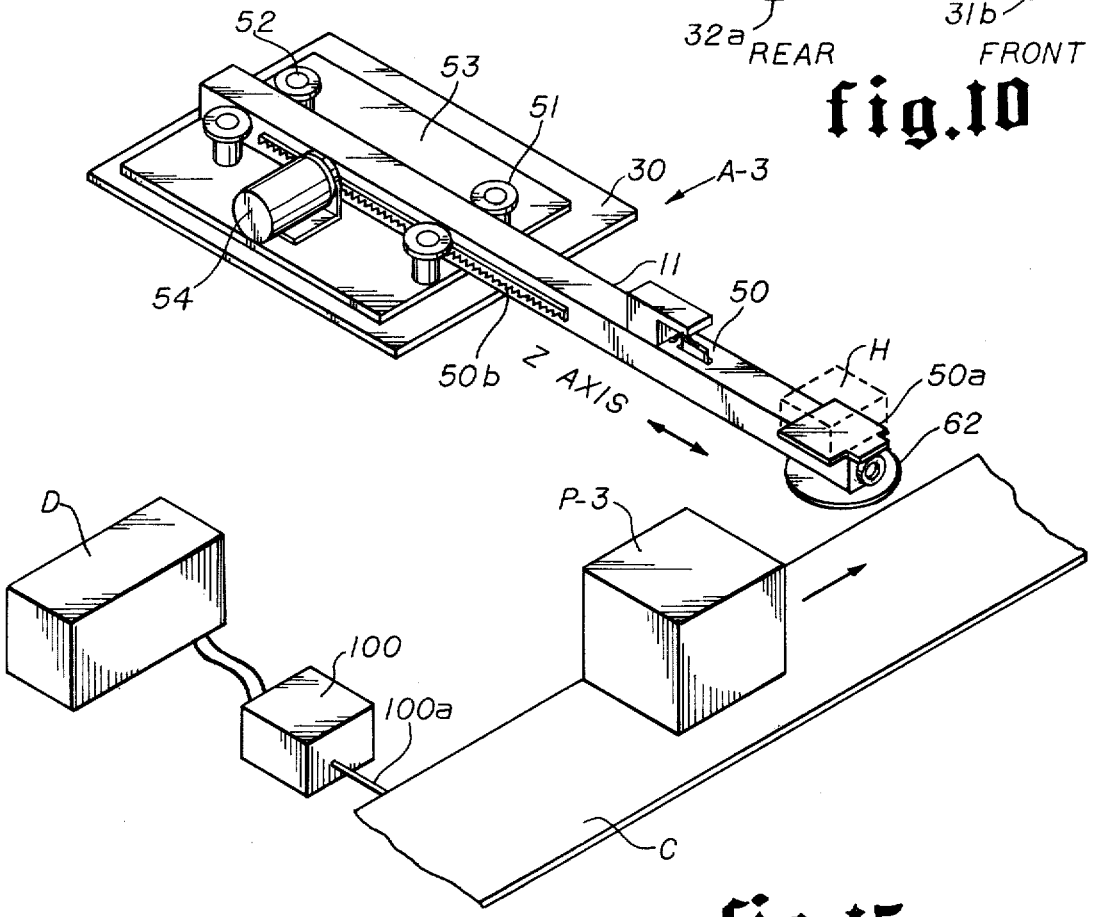
FIG. 15 is an isometric view, partly in schematic, of a third embodiment of this invention for a printing head positioning apparatus movable along a single axis for applying a label to a package or container having a known printable area.

The printing head positioning devices A-1, A-2, and A-3 disclosed in this patent application are adapted to receive and support a printing head H which is connected to a digital control system generally designated by the letter D in FIG. 15. The label printing head H can be, for example, a product of the A. B. Dick Company, sold under the trademark "Video Jet". The printing head control system is also available at A. B. Dick Company for operating the printing head H. The operation of the digital control system D for coordinating the movements of the various axes oriented moving systems described herein in conjunction with the printing head H has been described in U.S. Pat. No. 3,867,882 which has been previously identified.

The term "label" as used herein includes any sign, stencil or identification to be placed or printed on a package such as P-1.

Referring in particular to FIGS. 1–10, the label printing apparatus A-1 includes a probe unit which receives and supports the label printing head H for movement along three orthogonal axes "X", "Y" and "Z". In the embodiment A-1, the Z axis is defined as lateral movement toward and away from the package P-1. The Y axis represents vertical movement and the X axis represents horizontal movement as indicated in particular in FIGS. 1 and 3.

The printing head positioning apparatus A-1 basically includes a substantially square main frame unit 10 which supports the probe unit 11 with the printing head H mounted therewith, for movement along (parallel to) the X, Y and Z axes to first isolate a printable area on a package and then print a label thereon. The main frame unit 10 includes a bottom, base plate 10*a* which supports the vertically extending, axis carriage rods 10*b* and 10*c*. The axis rods 10*b* and 10*c* are joined by a top frame support plate 10*d* by suitable connections well known in the art. The apparatus A-1 may be generally described as including a probe unit mount means 14 which mounts the probe unit 11 for movement along the Z axis. The probe unit mount means 14 and the probe unit 11 are supported by a carriage assembly generally designated by the number 15. The carriage assembly 15 is mounted for movement along the X axis by an X axis mount means generally designated as 16; and, a Y axis mount means generally designated as 17 mounts the carriage assembly 15 for movement along the Y axis. In the apparatus A-1, the Y axis is vertical, the X axis is horizontal and the Z axis is lateral or horizontal in a direction toward and away from the package P-1.

The Y axis mount means 17 includes first and second pulley drives 18 and 19 which are mounted adjacent to the vertical axis carriage rods 10*b* and 10*c*. The pulley drives 18 and 19 include upper pulleys 18*a* and 19*a* mounted for rotation onto the top frame support 10*d* by suitable bearing means. The pulley drives 18 and 19 further include bottom pulley members 18*b* and 19*b* as mounted for rotation on frame support blocks 10*e* and 10*f* by suitable bearing means. The upper and lower pulleys 18*a* and 18*b*, and 19*a* and 19*b* are vertically aligned and have mounted thereon drive gear belts 18*c* and 19*c*. A suitable motor such as electric stepping motor 17*a* is mounted onto the base plate 10*a* and is connected to the drive shaft 20 by a suitable coupling 17*b* in order to impart drive rotation to the pulley drive gear belts 18*c* and 19*c*.

Both the frame support blocks 10*e* and 10*f* are mounted onto the frame base plate 10*a* by suitable means. The connecting drive shaft 20 extends between the frame support blocks 10*e* and 10*f* and is mounted onto the frame support blocks for rotation. The drive shaft 20 is directly connected to driving pulleys 18*b* and 19*b*. The connector drive shaft 20 thus serves to transmit rotation from the drive shaft, which is driven by the stepping motor 17*a*, to the pulley 18*b* and 19*b* and to synchronize the rotation of the pulleys and thus of the gear drive belts 18*c* and 19*c*. A torsion spring 21 provides a weight neutralizing means or counterbalance to continually urge the bottom pulleys 18*b* and 19*b* towards rotation in a direction which would serve to support and neutralize the weight of the carriage assembly 15 and X axis mount means 16 whereby the stepping motor 17*a* rotates the gear drive belts 18*c* and 19*c* to raise the probe unit 11 without having to overcome the weight of the carriage assembly 15 and the X axis means 16.

The X axis mount means 16 includes two horizontally disposed support rods 22*a* and 22*b* which terminate in slidable blocks 23 and 24. The slidable blocks 23 and 24 have suitable bushings therein to slidably mount the blocks for vertical movement along the vertical axis support rods 10*b* and 10*c*, respectively. The slidable block 24 is connected to the gear drive belt 19*c* by a clamping element 24*a* mounted onto the block 24 and clamped to one side of the drive belt 19*c*. The slidable block 23 is clamped onto the gear drive belt 18*c* by clamping element 23*a*. Thus, rotation of gear drive belts 18*c* and 19*c* imparts vertical movement to the slidable blocks 23 and 24 and the horizontal support rods 22*a* and 22*b* attached thereto. The torsion spring 21 is attached to the drive connector shaft 20 in such a manner as to urge the side of the gear drive belt such as 19*c*, which receives the clamping element 24*a*, upwardly in order to neutralize the weight of the slidable blocks 23 and 24, the horizontal shafts 22*a* and 22*b* and all members attached for movement therewith.

The vertical travel of the blocks 23 and 24 on vertical axis support rods 10*b* and 10*c*, respectively, may be limited by several different limiting assemblies. On the left side of the apparatus A-1, a limiting block 25 is clamped onto the vertical axis support rod 25 in order to mechanically prevent movement of the vertical block 23 beyond the block 25. On the right side of apparatus A-1, a separate rod 26 is mounted onto the frame base plate 10*a* and extends upwardly into attachment with the top frame support 10*d*. Mechanically adjustable cam elements 27*a* and 27*b* are mounted onto the rod 26. Upward movement of the support block 24 (and thus of the support block 23 and the horizontal rods 22*a* and 22*b*) is limited by an electrical limit switch or optical sensor 23. The limit switch 28 mounted onto slidable block 24 provides a limit signal to the digital control system D whenever the cam element 27*a* or 27*b* is engaged by the limit switch 28. Downward movement of the block 24 is limited by a second optical sensor or limit switch 29 mounted on slidable block 24 in position for engaging adjustable cam 27*b*. Such interruption will provide a signal to the digital control system D. Vertical limit signals from either the limit switches 28 or 29 will cause either reversal or a shut off of the stepping motor 17*a* in order to prevent further travel of the slidably mounted blocks 23 and 24 and the horizontal support rods 22*a* and 22*b* which mount the carriage assembly 15 and probe unit 11 attached thereto.

Figure 9:
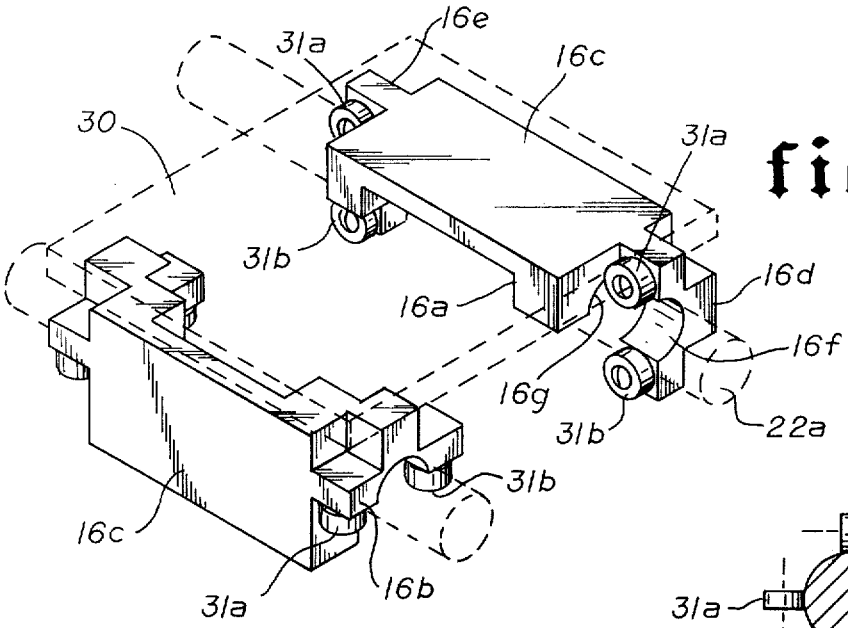
FIG. 9 is an isometric view, partially in schematic, of the frame of the carriage assembly.
Figure 10:
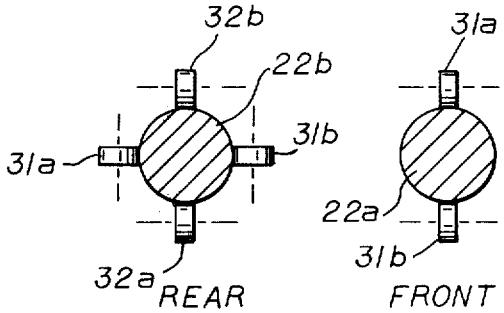
FIG. 10 is a schematic view of the mounting of the carriage frame of FIG. 9.

The X axis mount means 16 further includes a front carriage frame member 16*a* mounted onto the front horizontal support rod 22*a* for rollable movement with respect to the rod. A rear carriage frame member 16*b*, which is basically identical to the front carriage frame member 16*a*, is mounted for rollable movement on the rear horizontal support rod 22*d*. Since the front and rear carriage frame members 16*a* and 16*b* are basically identical, the same numbers and letters will be used to describe identical parts and features. Referring in particular to FIGS. 9 and 10, the carriage frame elements 16*a* include a flat surface 16*c*, and depending roller assemblies 16*d* and 16*e* formed at each end thereof. The depending roller assemblies 16*d* and 16*e* each include semi-cylindrical grooves or recesses 16*f* and 16*g* adapted to receive the horizontal support rods 22*a* and 22*b*. The carriage frame which rides on the front horizontal support rod 22*a* has top and bottom rollers 31*a* and 31*b*, and the flat surface 16*c* at the top supports fixed platform 30. The carriage frame which rides on the rear horizontal support rod 22*b* has top and bottom rollers 32*a* and 32*b*, and horizontal roller 31*a* and 31*b*. In this manner, the rear carriage frame 16*a* includes rollers which engage four oppositely positioned areas on the rear horizontal support rod 22*b* and thus securely mount the rear carriage frame 16*a* for movement along the rear horizontal support shaft 22*b*.

The front carriage frame member 16*a* is identical to the rear carriage frame member 16*b* except that only top and bottom rollers 31*a* and 31*b* are used. In this manner, it is only necessary to fully and accurately align the rear horizontal support rod 22*b*, thus saving significant time and effort in the construction of the apparatus A-1.

X axis drive means are mounted onto rear frame plate 10*g* for drivingly engaging the carriage assembly 15, which is formed by carriage frame members 16*a* and 16*b* and the fixed platform 30, for oscillating the carriage assembly 15 along the X axis. An endless belt drive assembly generally designated as 34 includes horizontally positioned drive pulley 34*a* and 34*b* mounted for rotation onto the rear frame plate 10*g*. The horizontally disposed drive pulleys 34*a* and 34*b* have mounted thereon a gear drive belt 35 which is rotated by means of a suitable motor 33 which is mounted onto the rear frame member 10*g* and is suitably, drivingly connected to the pulley 34*b*. In this manner, activation of the drive motor 33 causes rotation of the drive belt 35.

Figure 2:
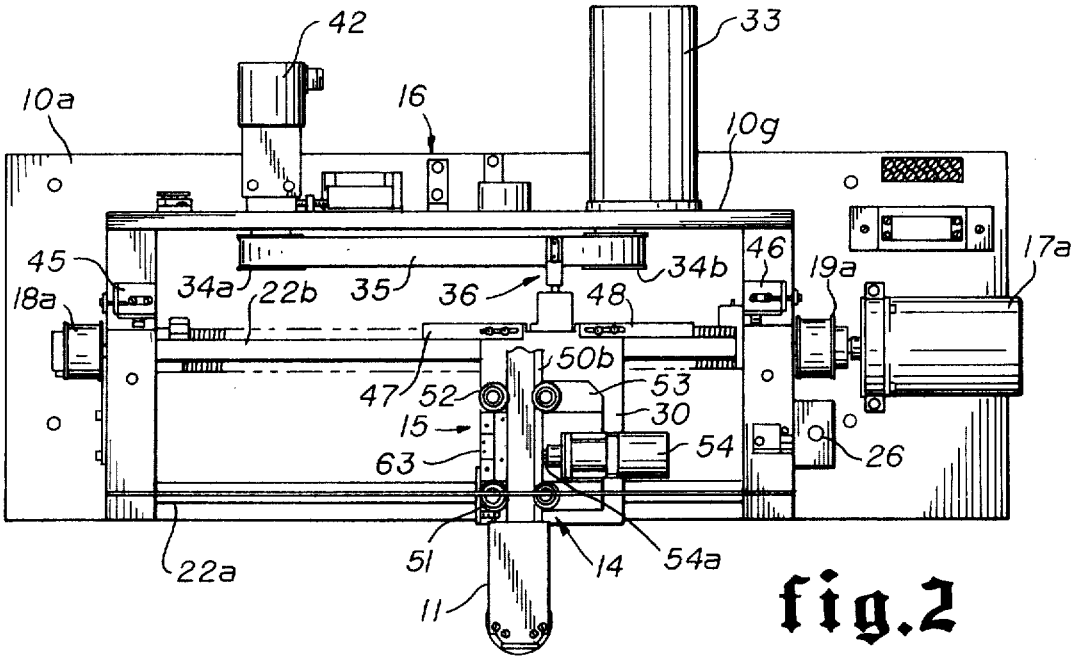
FIG. 2 is a top view of the printing head positioning apparatus of FIG. 1.
Figure 1:
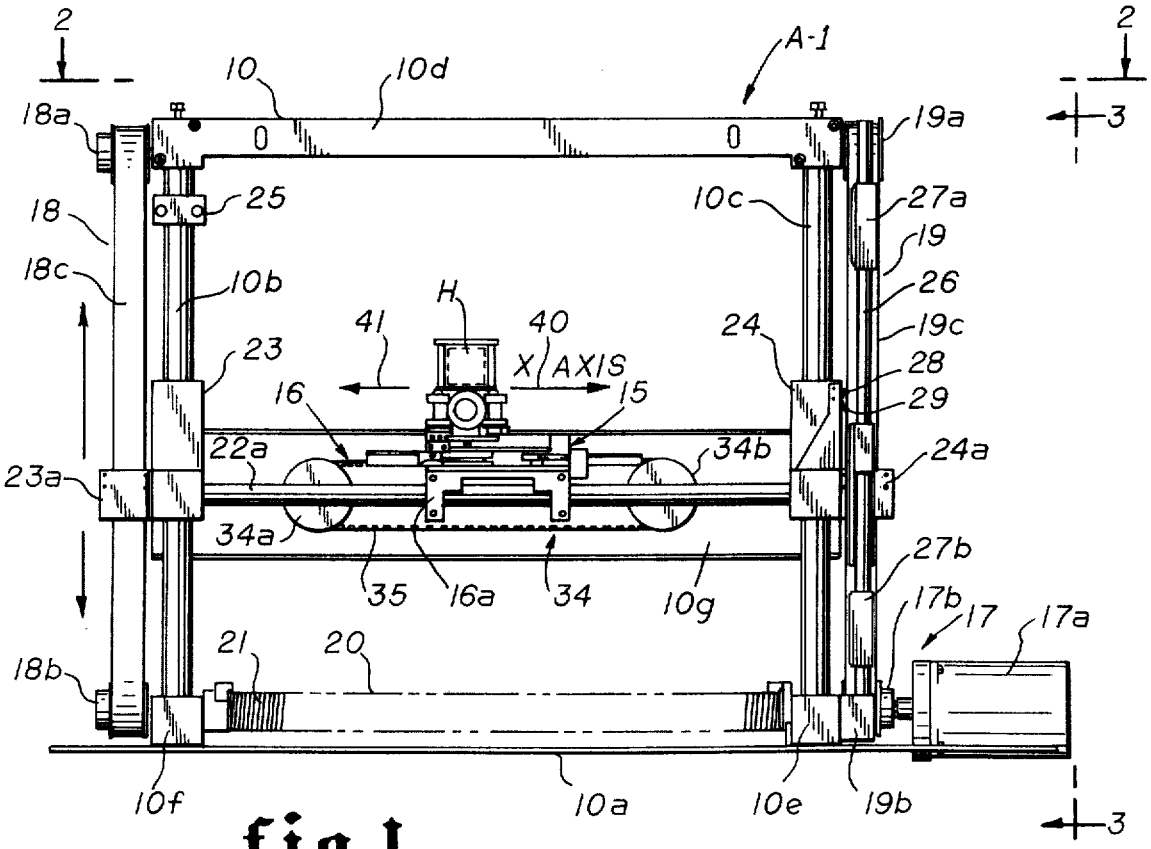
FIG. 1 is a front view of the printing head positioning apparatus of a preferred embodiment of this invention.
Figure 3:
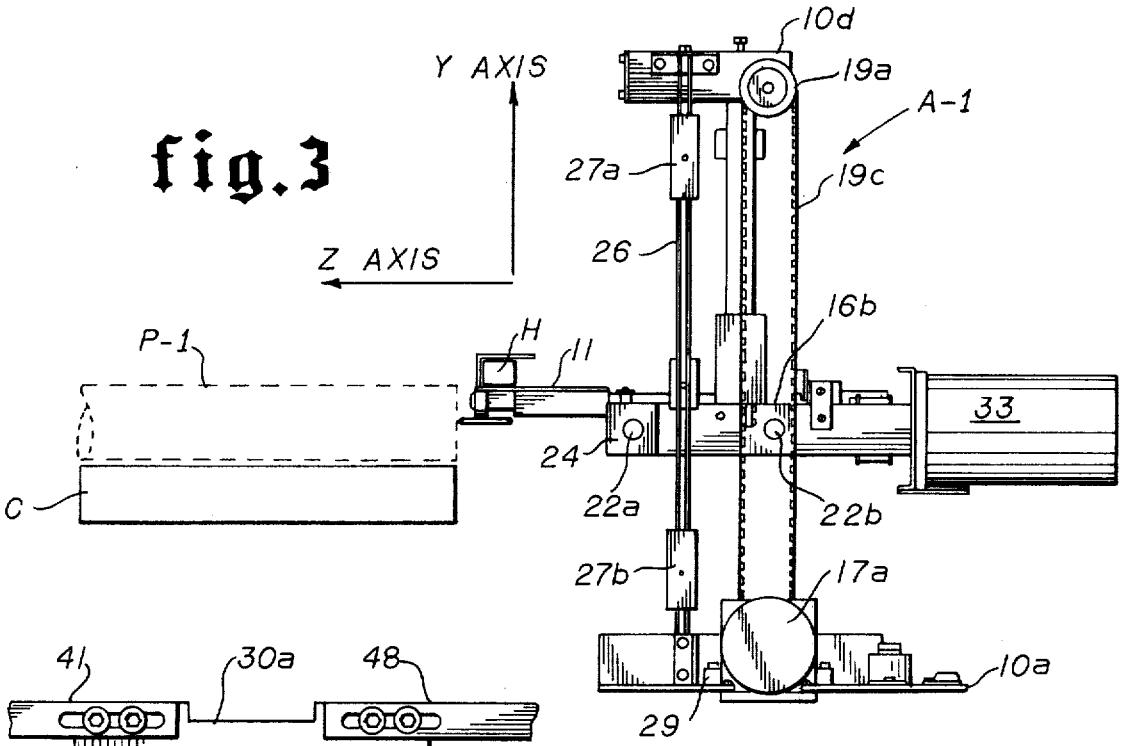
FIG. 3 is a side view of the positioning apparatus.
Figure 6:
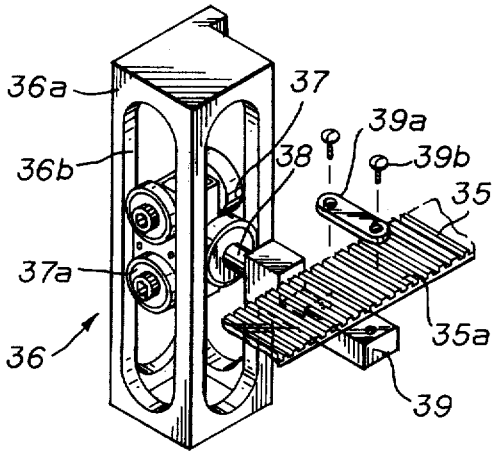
FIG. 6 is an isometric view of the endless belt drive connector for continuously driving the carriage assembly of this invention.

Referring to FIGS. 1, 2 and 6, the gear drive belt 35 is connected to the rear carriage frame member 16*b* by a floating, pivotal connector means 36. The floating pivotal connector means 36 includes a cage 36*a* which is attached by suitable means to rear carriage frame member 16*b* and extend upward into recessed platform portion 30*a*. The cage 36*a* is basically a rectangular housing having four elongated, vertical recesses 36*b* in the sides thereof. A roller assembly 37 is mounted within the cage 36*a* and includes four sets 37*a* of rollers which are mounted in the four elongated, vertical recesses 36*b* for vertical movement therein. A connector shaft 38 is pivotally connected to the roller assembly 37 and has mounted therewith a clamping element 39 which is adapted to engage the outside 35*a* of the gear drive belt 35. A clamping plate 39*a* is positioned on the gear tooth side of the gear drive belt and is attached to the clamping element 39 by suitable screws such as 39*b* or the like.

The vertically adjustable, pivotal connector means 36 between the gear drive belt 35 and the carriage platform 30 allows the carriage 15 to be oscillated along the the X axis by continuous movement of the gear drive belt 35. This eliminates the necessity of having to reverse the motor 33 in order to reverse the direction of the carriage assembly 15 and the probe unit 11 mounted thereon. Thus the carriage assembly 15 is movable along the X axis in the direction of arrow 40 when the connector means 36 is riding along the upper path of the gear drive belt 35 and moves the carriage 15 in the direction 41 along the X axis when the connector means 36 is positioned along the lower portion of the gear belt drive.

One of the purposes of the X axis mounting means 16 is to cause the printer head H mounted on the probe unit 11 to scan during the actual application of a label to a package such as P. Such scanning path includes movement in the X axis in a first direction 40 and then a shifting of the carriage assembly 15 and thus of the printer head H vertically along the Y axis and thereafter a return scan along the X axis in direction 41. This scanning procedure is repeated until the entire label is printed. Thus the printing head H as controlled by the digital control system D actually prints in both directions 40 and 41 along the X axis with vertical or Y indexing occuring between individual scans. The motor 33 may be continuously run during the scanning operation described herein due to the vertically floating, pivotal connection between the gear drive belt 35 and the carriage platform 30. Actual scanning and printing by the printing head H need only occur during movement of the carriage 15 between the pulleys 34*a* and 34*b*. An angle encoder 42 is mounted onto the rear frame panel 10*g* in rotatable connection with pulley 34*a* in order to provide angular displacement feedback to the digital control system D. The angle encoder utilized in the preferred embodiment of this invention is sold under the trademark "Accu-Coder", Model 711 by Encoder Products Company of Utah. One of the purposes of the encoder 42 is to provide position feedback to the digital control system D and to prevent the application of ink by the printing head H during travel of the vertically adjustable, pivotal connector means 36 around the pulleys 34*a* and 34*b*.

In addition, optical sensors 45 and 46 are mounted on the vertically slidable blocks 23 and 24, respectively, in substantial horizontal alignment with the carriage platform 30. Adjustable signal arms 47 and 48 are mounted onto the carriage platform 30 and extend outwardly therefrom in directions 41 and 40, respectively, of the X axis. The positions of the signal arms 47 and 48 are adjusted to interrupt the optical sensors 45 and 46 and thus provide input signals to the digital control system D at each end of the X axis scan. The feedback signals provided by the optical sensors 45 and 46 cooperate with the feedback signal provided by the encoder 42 to continually reset and count the scanning cycles of the printer head H mounted on the probe unit 11 on the oscillating carriage assembly 15.

Figure 4:
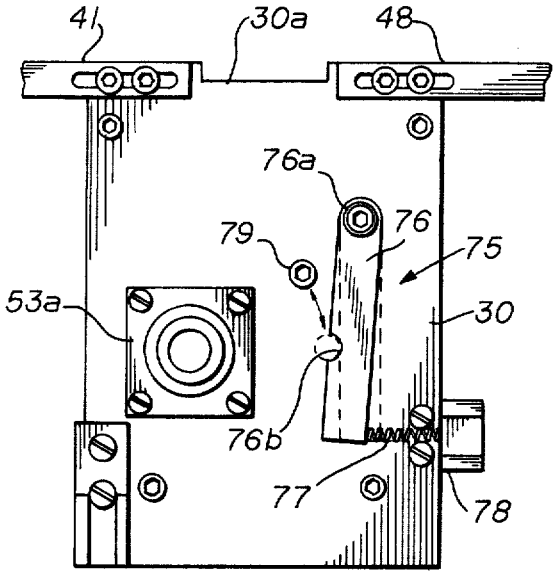
FIG. 4 is a top view, partly in schematic, of the break-away structure of the printing head positioning apparatus.

The probe unit mount means generally designated as 14 mounts the probe unit 11 onto platform 30 for movement along the Z axis toward and away from a package P-1 which may be positioned on a conveyor C for travel in front of the apparatus A-1. The probe unit 11 includes an elongated, external housing 50 having the printing head H mounted at the front end 50*a* thereof. The probe unit 11 is mounted for movement along the Z axis toward and away from a package P-1 by means of two roller sets 51 and 52 mounted on a movable or rotatable platform 53. The movable platform 53 forms part of the probe unit mount means 14 and is pivotally mounted to the stationary or fixed carriage platform 30 by means of a suitable bearing structure 53*a* such as illustrated in FIG. 4. The sets 51 and 52 of rollers are mounted on the rotatable or movable platform 53 in rolling engagement with the elongated probe housing 50 thus mounting the probe housing 50 and the printing head H mounted thereon for movement along the Z axis. Z axis power means includes a suitable electric motor 54 mounted onto the rotatable platform 53. The motor 54 a driving gear at 54*a* for engaging the probe unit rack 50*b* for moving the probe unit 11 along the Z axis.

The probe unit 11 further includes a sensor sleeve 55 which is generally cylindrical in cross-section and includes an enlarged front end area 55*a* having a smooth, flat face 55*b*. the sensor sleeve 55 is hollow and mounts therein a magnetic sensor 56. The sensor sleeve 55 further includes a series of circumferentially spaced flutes 55*c* which serve to frictionally mount the sensor sleeve 55 within the front end 50*a* elongated rectangular probe unit housing 50. The sensor 56 is magnetically sensitive to provide change of direction signals to the digital control system D in response to proximity to a metal band or the like on the package P-1.

The sensor 56 is attached to a sensor mount 57 which is inserted into the probe unit housing 50. The sensor electrical connection 58 extends through a rear end mount 59 which is positioned within the housing 50 at the rear end 50*c*. A spring 60 is positioned between mount 59 and the sensor mount 57 in order to continually urge the sensor mount, the sensor element 56 and the sensor sleeve 55 outwardly into engagement with a portion of the package P-1.

An L-shaped clamp 61 is mounted onto the sensor sleeve 55 and extends downwardly therefom to mount for rotation a wheel or disc 62 by suitable means. The wheel or disc 62 is adpated to roll along in continuous engagement with the surface of the package P-1.

Movement and position of the entire probe unit 11 is determined by two separate position control assemblies.

The first position control assembly, which may be generally designated by the number 70, provides for limiting the extended and retracted positions of the probe unit housing 50. The external housing unit 50 has mounted thereon camming elements 50*d* and 50*e* that cooperate with suitable limit switches generally designated as 63 (FIG. 2) mounted on the rotatable platform 53. The cam element 50*d* acts to engage a suitable micro switch element at 63 in order to provide a signal to the digital control system D whenever the probe unit housing 50 reaches a maximum extended position. Similarly, the cam unit 50*e* acts to engage a micro switch at 63 in order to indicate to the digital control system D that the probe unit 11 is fully withdrawn. Signals provided by the limit switches at 63 will cause the digital control system D to de-activate the probe drive motor 54.

The second position control assembly is generally designated by the number 72. The position control assembly 72 actually acts to allow the sensor sleeve 55 to float somewhat with respect to the probe unit housing 11 in order to allow the contact wheel 62 to continuously engage the package P-1 and position the printing head H in spite of minor variations in the contour of the printable area of the package P-1. A L-shaped bracket 72*a* is mounted by suitable means onto the probe unit housing 50. A camming element or ledge 72*b* is mounted by suitable means such as a screw 72*c* onto the sensor mount 57 such that the camming element 72*b* moves with the sensor sleeve 55 and sensor mount within the probe unit housing 50. Limit switch arms 72*c* and 72*d* are illustrated as extending downwardly from the L-shaped bracket 72*a*. These limit switch arms 72*c* and 72*d* represent limit switches which are in electrical connection with the digital control system D. Whenever the sensor sleeve 55 and thus the cam element 72*b* is positioned directly under both limit switch arms 72*c* and 72*d*, the drive motor 54 is deactivated. That is, the limit switch arms 72*c* and 72*d* send signals which shut off the motor 54 whenever the arms 72*c* and 72*d* are in a raised position on top of the cam element 72*b*.

Figure 7:
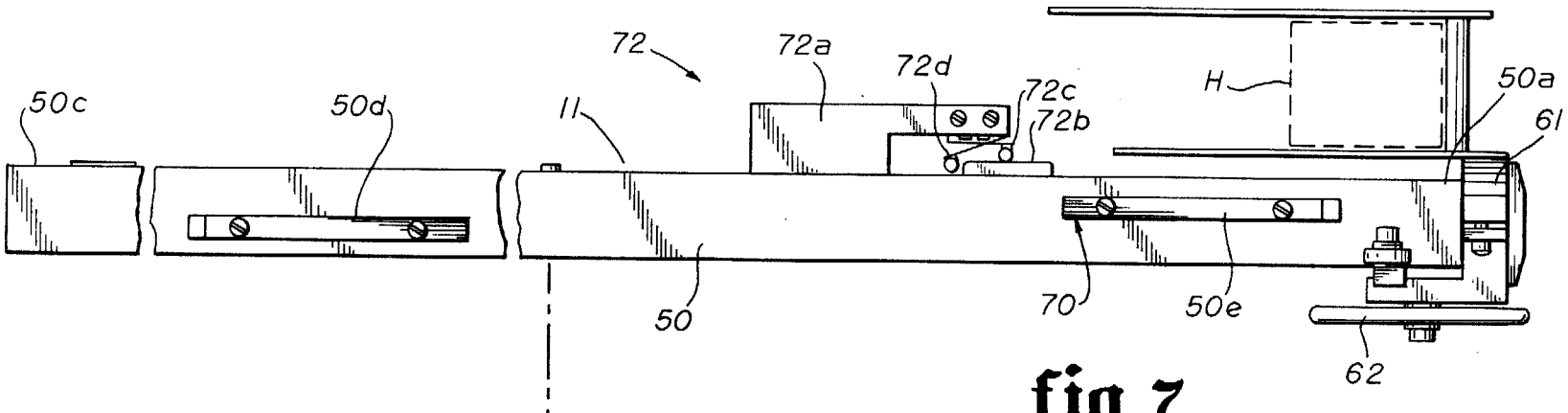
FIG. 7 is a side view of the probe unit of the printing head positioning apparatus.
Figure 8:
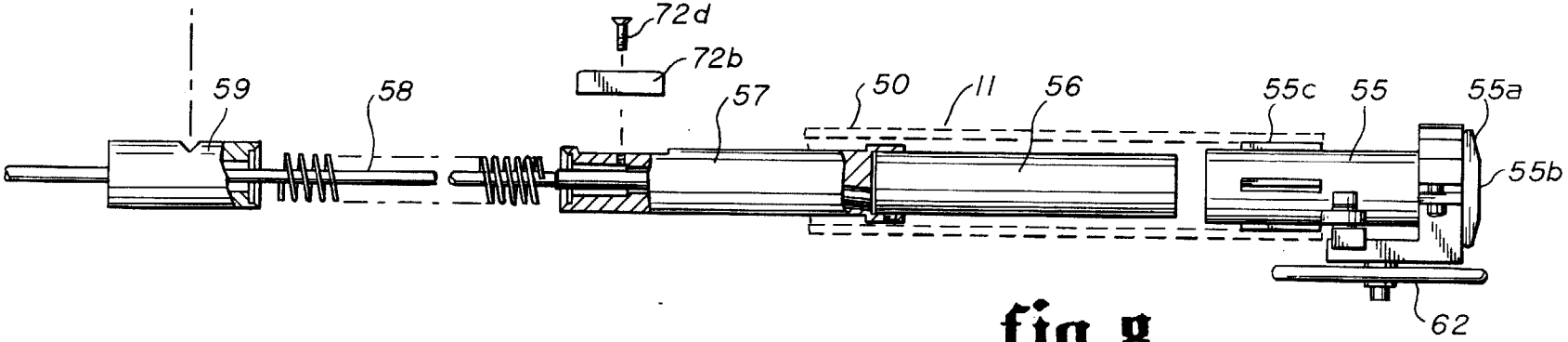
FIG. 8 is an assembly view of the probe unit of FIG. 7.

Referring to FIG. 7, the sensor sleeve 55 and thus the camming element 72*b* is capable of moving a limited amount relative to the probe unit housing 50 while maintaining the limit switch arms 72*c* and 72*d* in a raised position. This is due to the width of the cam element 72*b* with respect to the distance between limit switch arms 72*c* and 72*d*. The sensor sleeve face 55*b* is capable of engaging some slight deviations in the surface of the package P-1 while keeping the limit switch arms 72*c* and 72*d* in a raised position and the motor 54 turned off.

However, whenever the sensor sleeve 55 and the camming element 72*b* are moved out of the housing 50 an undesirable distance, the limit switch arm 72*d* is pivoted down wherein a signal is sent to the digital control system D, which signal causes the motor 54 to reverse and move the entire probe unit 11 outwardly until limit switch 72*d* is pivoted upward. Similarly, whenever the sensor sleeve 55 is pushed inwardly of the probe unit housing 11 an undesirable amount, the limit switch arm 72*c* is pivoted down to a position in which a signal is sent to the digital control system D which reverses the motor 54 causing the probe unit 11 to be moved rearwardly until limit switch 72*c* is pivoted upward.

The digital control system D for controlling the position of the printing head H mounted on the probe unit 11 has been previously described in U.S. Pat. No.

3,867,882. Basically, such control digital system D includes a computer which converts an input request for a particular sign or label into the proper binary control signals to operate a printing system interface which delivers printing signals to the printing head H. In addition, a complete binary control network is disclosed in U.S. Pat. No. 3,867,882 for digitally controlling the position of the probe unit 11 during both the initial searching operation to find a printable area on the package P-1 and during the indexing period for causing the printing head H to systematically scan the printable area.

Figure 5:
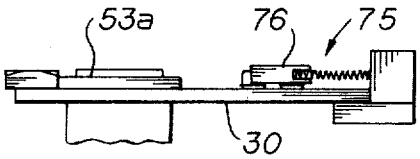
FIG. 5 is a sectional view taken along line 5—5 of FIG. 4.

Referring in particular to FIGS. 4 and 5, a breakaway means generally designated by the number 75 is mounted with the probe unit 11 for releasing the probe unit 11 from movement along the Z axis in response to the probe unit 11 engaging an undesirable force or resistance. For example, there may be situations where the probe unit 11 is exposed to the end of a package P-1 positioned too close to the probe unit 11 to allow the probe unit 11 to retract out of the way of the package. In this circumstance, the breakaway means 75 operates to release the probe unit 11 for pivotal movement away from the end portion of the package P-1. The break-away means 75 includes a detent arm 76 which is pivotally mounted by a suitable bearing 76*a* onto the fixed platform 30. The detent arm 76 includes a notched portion 76*b*. A coil spring 77 is attached to the free end of the detent arm 76 and is held in position by a suitable spring holding mechanism generally designated as 78 attached to the fixed platform 30. The coil spring 77 acts to hold the detent arm 76 in the normal position illustrated in solid lines in FIG. 4. The rotatable platform 53 includes a downwardly depending roller 79 which is normally inserted in the detent arm notched portion 76*b*. In this normal position, the probe unit 11 mounted on the pivotal platform 53 is held in a position to move along or parallel to the Z axis.

Whenever the probe unit 11 engages an undesirable resistance, the roller 79 exerts a break-out force on the detent arm notched portion 76*b* which depresses the spring 77. Depression of the spring 77 allows the roller 79 to move out of the detent arm notched portion 76*b* thus freeing the pivotal platform 53 and the probe unit 11 mounted thereon for movement away from the encountered resistance. The size of the depending roller 79, the position of the detent arm notched portion 76*b*, and the compression resistance of the spring 77 cooperate to determine what force of resistance will cause the probe unit 11 to break away from movement along the Z axis. The break-away means 75 thus acts to allow the probe unit 11 to be moved out of the way of a resistance which would normally damage the probe unit.

In operation and use of the apparatus A-1, the digital control system D receives the designated input information to program the printer system interface to print the desired sign or label onto the package P-1. After such programming, the apparatus A-1 is ready to search out a printable area and print the sign onto the package P-1. Generally, the apparatus A-1 is positioned adjacent to a conveyor C which carries along a series of packages P-1 which must be labeled. As a package P-1 approaches the apparatus A-1, a suitable photocell or other actuation switch (not shown) is activated to switch on the entire apparatus A-1. The digital control system D then acts to cause the probe unit 11 to move into engagement with the package P-1 and search out a printable area on which the printing head H can print the desired label or sign.

The actual scanning technique utilized has been described in the previous U.S. Pat. No. 3,867,882. Basically, it involves moving the probe unit 11 along the X and Y axes until a suitable printing area is isolated. During this movement, the sensor sleeve 11 is positioned immediately adjacent to the package P-1 by the engagement wheel 62, which is held in continuous, yieldable engagement with the package P-1 by means of the probe unit control assemblies 70 and 72. Thus, if the engagement wheel 62 engages a force which moves the camming element 72*b* too far inwardly of the probe unit housing 50, the limit switch arm 72*c* will be allowed to move downwardly thereby causing the motor 53 to move the entire probe unit housing 50 inwardly.

Once the printable area of the package P-1 has been determined, the printing head H is positioned by the computer at one end of the printable area. Thereafter, the motor 17*a* of the Y axis mount means and the motor 33 of the X axis mount means, controlled by the digital control system D, move the printing head H through a series of scans along the X axis with vertical steps between each scan. After the desired label has been printed onto the package, the digital control system D acts to shut off the printer head H and withdraw the probe unit 11 such that the apparatus A-1 is prepared to receive the next package P-1.

Figure 13:
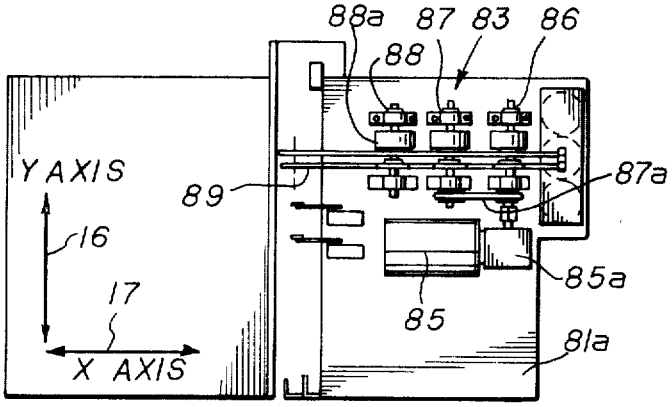
FIG. 13 is a top view of the printing head positioning apparatus of FIG. 11.

The apparatus A-2 illustrated in FIGS. 11–14 is particularly adapted for applying a label or sign to the top surface S of a package P-2. By way of example, the top surface S may be an upper curved surface such as the upper half of a cylindrical roll or it may be a top flat surface of a rectangular package. The apparatus A-2 basically includes a portable label printing unit 80 which is supported on a main frame assembly 81. A height adjustment means generally designated as 82 is mounted on the main frame assembly 81 for adjusting the vertical position of the entire portable label printing unit 80. The portable label printing unit 80 is basically identical to the entire apparatus A-1; however, the orientation of the unit 80 is different from the orientation of the apparatus A-1. The probe unit 11 illustrated in scored lines in FIG. 11 for the portable unit 80 is positioned for movement along a Z axis which is vertical. The X axis mount means 16 mounts the probe unit 11 for movement in the horizontal direction illustrated in FIG. 13. The Y axis mount means 17 mounts the probe unit 11 for movement along a horizontal axis perpendicular to as in the same plane as the X axis as illustrated in FIG. 13. In the apparatus A-1, the Y axis mount means mounts the probe unit 11 for movement in a vertical direction and the torsional spring 21 was provided for neutralizing the weight of the probe unit 11 and the carriage assembly 15. In the apparatus A-2, the Y axis is in a horizontal plane making the torsional spring 21 unnecessary. Otherwise, the structure of the X axis mount means 16, the Y axis mount means 17, the carriage assembly 15 and the probe unit 11 are basically identical in structure to these same elements as described on the apparatus A-1.

The height adjustment means 82 is provided for initially positioning the portable label printing unit 80 with respect to the upper surface S of the package P-2. The height adjustment means 82 includes a drive sprocket arrangement generally designated as 83 and a safety counter-balance arrangement generally designated by the number 84. The drive sprocket arrangement 83 includes an electric drive motor 85 mounted onto a frame platform 81*a*. The drive motor is connected to a first sprocket 86 through a suitable gear box 85*a*. The drive motor is alternately connected to a second sprocket 87 through a drive chain 87*a*. A third sprocket 88 includes a braking member 88*a*. Each of the sprockets 86, 87 and 88 are thus positioned adjacent to the drive motor 85 and each include gear teeth for receiving a chain drive belt 89. The chain drive is threaded through the sprockets 86, 87 and 88 and upwardly about an idler sprocket 90 into suitable attachment with the portable unit 80. The chain drive 89 also extends upwardly from connection with sprocket 86 about an idler sprocket 91 and downwardly into connection with a counterweight. Each of the sprockets 86, 87 and 88 are suitably mounted on pillow block bearings or the like for rotation. The chain drive 89 extends under the sprocket 86 and over the sprocket 87. Suitable clutch means are mounted with the sprockets 86 and 87 in order to alternately engage and disengage the chain drive 87*a* from the sprockets 86 and 87. In this manner, the direction of travel of the chain drive 89 may be altered, thus altering the direction of travel of the portable unit 80 upwardly and downwardly on the frame 81.

The safety counterbalance arrangement 84 includes a safety chain 93 which extends over idler sprockets 94 and 95 to the portable unit 80 and to the counterbalance 92.

Figure 14:
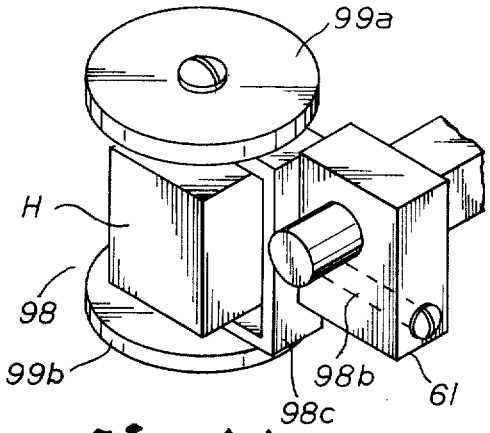
FIG. 14 is an isometric view of the yoke for mounting the label printing head for this second embodiment of the label printer positioning apparatus.
Figure 11:
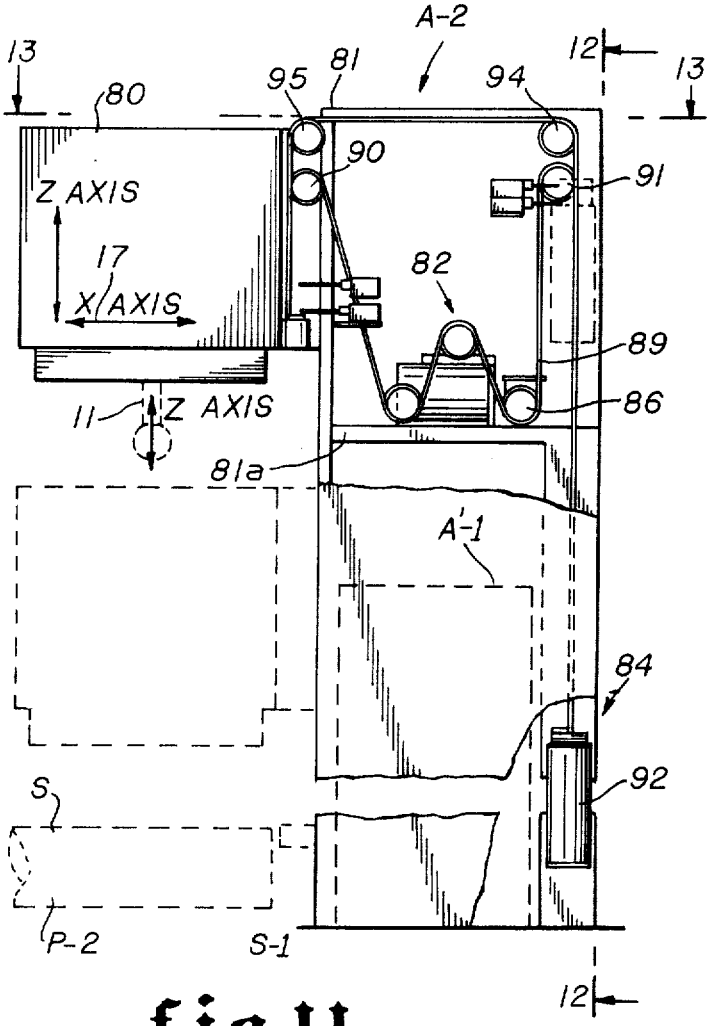
FIG. 11 is a side view, partly in schematic, of a printing head positioning apparatus of a second embodiment of this invention for applying a label to the top surface of a package.
Figure 12:
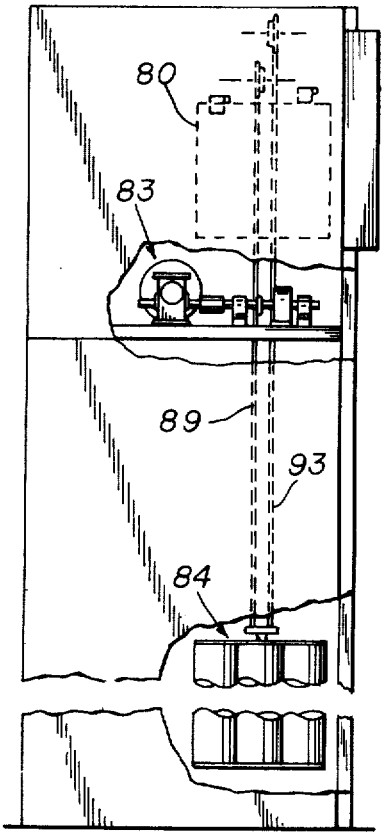
FIG. 12 is a rear view, partly in schematic, of the printing head positioning apparatus of FIG. 11.

Referring in particular to FIG. 14, the probe unit 11 is structurally identical to the probe unit of the apparatus A-1 except that a rolling yoke 98 is substituted for the contact wheel 62. The yoke 98 is screwed onto the sensor clamp 61. The sensor clamp 61 mounts a yoke shaft 98*b* for pivotal movement with respect thereto; and, a U-shaped mounting bracket 98*c* is attached to the yoke shaft 98*b* for pivotal movement therewith. The U-shaped bracket 98*c* mounts the printing head H therein by suitable means such as bolts or the like. A set of side rollers 99*a* and 99*b* are mounted onto the U-shaped bracket 98*c* for continuous, rolling engagement with the top surface S of the package P-2. The shaft 98*b* serves to mount the rollers 99*a* and 99*b* for pivotal movement with respect to the remainder of the probe unit 11; and, the rollers allow the probe unit 11 to roll across the package surface S along the X axis. The rollers 99*a* and 99*b* further serve to maintain the printing head H at substantially the same distance from the top package surface S even though the surface S may be curved.

Another label printer positioning apparatus A$^1$-1 may be housed in the same frame 81 below the portable unit 80 for the purpose of applying a label to another side S-1 of the package P-2 simultaneously with the application of a label to the top surface S by the portable unit 80.

Referring to FIG. 15, apparatus A-3 is illustrated for applying a label or sign to a package P-3 moving along a conveyor C in coordination with the speed of the conveyor. The apparatus A-3 includes a probe unit 11 which is movable along the Z axis only. The probe unit 11 and the structure supporting the probe unit are identical to comparable structure in the apparatus A-1; therefore, identical numbers will be used to describe identical elements and features. The probe unit 11 is mounted for movement along the Z axis by roller sets 51 and 52 which are mounted on a pivotal platform 53. The pivotal platform 53 is mounted for pivotal movement onto a fixed platform 30 which may be mounted on any stationary structure. The probe unit 11 is driven along the Z axis in exactly the same manner as disclosed in apparatus A-1. Therefore, a drive motor 54 includes a suitable gear drive for engaging the rack 50*b* mounted onto the side of the probe unit housing 50. The printing head H is mounted onto the front end 50*a* of the probe unit and the contact wheel 62 is adapted to continually engage the surface of the package P-3 passing by on the conveyor. The probe unit 11 is mounted to follow the contour of the surface of the package P-3 as previously described.

A tachometer 100 or other similar device is operably connected to the conveyor C for providing electrical signals indicative of conveyor speed to the digital control system D. The digital control system D has been previously described and includes proper signal interpreting and converting means for controlling the rate of printing of the printing head H in response to the speed of the conveyor C. The tachometer 100 includes an input shaft 100*a* which may be directly connected to a conveyor drive motor or other conveyor structure which will vary the rotation of the shaft 100*a* in response to variations in the speed of the conveyor C.

The foregoing disclosure and description of the invention are illustrative and explanatory thereof, and various changes in the size, shape, and materials as well as in the details of the illustrated construction may be made without departing from the spirit of the invention.

We claim:

1. Apparatus for positioning a printing head for directly printing a label onto a package or the like, comprising:

a probe unit supporting a printing head for movement therewith;

probe mount means mounting said probe unit for movement along a first axis toward and away from a package;

a carriage assembly supporting said probe unit and said probe unit mount means;

second axis mount means mounting said carriage assembly for movement along a second axis orthogonal to said first axis;

third axis mount means mounting said carriage assembly for movement along a third axis orthogonal to said first and second axes;

said probe mount means including break-away means mounting said probe unit for release from movement along said first axis in response to said probe unit engaging an undesirable resistance; and control means for coordinating the movement of said probe unit along said first, second and third axes for positioning said probe unit and printing head to print a label directly onto said package.

2. The structure set forth in claim 1, including:

said third axis being vertical; and means continuously urging said carriage assembly upwardly in order to at least partially neutralize the weight of said carriage assembly.

3. The structure set forth in claim 1, wherein said third axis mount means includes:

an endless belt drive supported by spaced pulley members;

means attaching said carriage assembly to said endless belt drive; and power means for driving one of said pulleys for rotating said belt drive.

4. The structure set forth in claim 3, including:
said power means includes a drive shaft operably connected to one of said spaced pulley means; and
said drive shaft having a torsion spring mounted therewith for urging said carriage assembly upwardly to neutralize the weight of said carriage assembly.

5. The structure set forth in claim 1, wherein said second axis mount means includes:
a support rod extending parallel to said second axis;
said carriage assembly including a carriage frame mounted for movement along said support rod;
second axis drive means including an endless belt mounted on pulleys which are oriented along said second axis; and
connector means connecting said carriage frame to said endless belt for bi-directional movement along said second axis.

6. The structure set forth in claim 5, wherein said connector means includes:
pivot means for pivotally connecting said carriage frame to said endless belt; and
means mounting said pivot means for movement along said third axis whereby said carriage frame reciprocates in response to continuous movement of said endless belt.

7. The structure set forth in claim 1, wherein said break-away means includes:
pivot means mounting said probe unit onto said carriage assembly for pivotal movement with respect thereto; and
means releaseably maintaining said probe unit in position for movement along said first axis, said probe unit being released for pivotal movement in response to said probe unit engaging an undesirable resistance.

8. The structure set forth in claim 1, including:
a carriage assembly including a carriage frame mounted for movement along said second axis;
said break-away means including a break-away platform having said probe unit and probe unit mount means mounted therein;
pivot means pivotally mounting said break-away platform for pivotal movement with respect to said carriage frame; and
detent means releaseably holding said break-away platform in position for said probe unit to move along said first axis and for releasing said break-away platform for pivotal movement away from said first axis in response to said probe unit engaging an undesirable force.

9. The structure set forth in claim 1, including:
said probe unit including an elongated housing supporting said printing head;
said elongated housing having a rack gear mounted therewith; and
probe drive means including a gear drive for engaging said rack gear for moving said probe unit along said first axis.

10. The structure set forth in claim 9, including:
said probe unit mount means including a spaced set of rollers which rollingly engage said elongated housing.

11. The structure set forth in claim 8, wherein said detent means includes:
a detent arm and means yieldably mounting said detent arm onto said carriage frame; and
a break-away element attached to said break-away platform and extending into releaseable engagement with said detent arm.

12. Apparatus for positioning a printing head for printing a label on a top surface of a package or the like, comprising:
a portable label printing unit including:
a probe unit adapted to receive and support a printing head;
probe mount means mounting said probe unit for vertical movement toward and away from the top surface of a package;
a carriage assembly for supporting said probe unit and first power means mounting said carriage assembly for movement along a first horizontal axis in a horizontal plane;
second power means mounting said carriage assembly for movement along a second horizontal axis perpendicular to said first horizontal axis and in the same plane as said first horizontal axis;
height adjustment means mounting said portable label printing unit for vertical movement; and
control means for coordinating the operation of said probe unit, first and second power means and said height adjustment means to isolate a printable area on said top package surface and for printing a label directly thereon.

13. The structure set forth in claim 12, wherein said height adjustment means includes:
a main frame assembly;
vertical drive means mounted with said main frame assembly and connected with said portable label printing unit; and
means for neutralizing the weight of said portable unit in order to substantially reduce the force necessary to raise said portable label printing unit.

14. The structure set forth in claim 12 wherein: said height adjustment means includes:
a main frame assembly;
a first sprocket and chain arrangement mounted with said main frame assembly and including a drive means for driving said chain and raising and lowering said portable label printing unit; and
a second sprocket and chain arrangement mounted on said main frame assembly and attached to said portable label printing unit and to a counterweight to neutralize the weight of said portable label printing unit.

15. The structure set forth in claim 12, wherein said probe unit includes:
break-away means mounting said probe unit for release from vertical movement in response to said probe unit engaging an undesirable resistance.

16. The structure set forth in claim 12, including:
a second label printing apparatus positioned adjacent to said portable label printing apparatus and including means for printing on another package surface.

17. The structure set forth in claim 12, wherein said probe unit includes:
an elongated housing including a protruding end portion;
a yoke pivotally mounted onto said housing end portion said yoke being adapted to receive and support said printing head; and
wheels mounted onto said yoke for rotation with respect thereto for continuously engaging said top package surface.

* * * * *